US005773131A

United States Patent [19]

Dettling

[11] Patent Number: 5,773,131

[45] Date of Patent: Jun. 30, 1998

[54] PAPER OR CARDBOARD PRODUCT

[76] Inventor: Bernhard Dettling, Am Bienenbuckel 19, 77855 Achern, Germany

[21] Appl. No.: 400,922

[22] Filed: Mar. 9, 1995

[30] Foreign Application Priority Data

Mar. 9, 1994 [DE] Germany ..... 44 07 878.1

[51] Int. Cl.[6] ..... B32B 3/10

[52] U.S. Cl. ..... 428/201; 428/21; 428/34.2; 428/36.3; 428/36.7; 428/342; 428/507; 428/511; 428/514; 428/515; 428/519; 428/521; 428/522; 428/537.5; 162/137

[58] Field of Search ..... 428/507, 511, 428/514, 515, 519, 521, 522, 537.5, 34.2, 36.6, 36.7, 201, 211, 342; 162/135, 137

[56] References Cited

U.S. PATENT DOCUMENTS

| | | | |
|---|---|---|---|
| 3,896,065 | 7/1975 | Reardon et al. . | |
| 4,304,626 | 12/1981 | Shaw et al. | 162/168.1 |
| 4,487,657 | 12/1984 | Gomez | 162/158 |
| 5,330,845 | 7/1994 | Anderson et al. | 428/487 |
| 5,506,011 | 4/1996 | Farrell et al. | 428/34.2 |

FOREIGN PATENT DOCUMENTS

| | | |
|---|---|---|
| 703729 | 2/1968 | Belgium . |
| 0375924 | 7/1990 | European Pat. Off. . |
| 0393451 | 10/1990 | European Pat. Off. . |
| 4227184 | 2/1994 | Germany . |
| 9426513 | 11/1994 | WIPO . |

*Primary Examiner*—Marie Yamnitzky
*Attorney, Agent, or Firm*—Robert W. Becker & Associates

[57] ABSTRACT

A paper product has a base body with an upper surface and a bottom surface. A primer coating is applied in the form of a primer coating mixture to at least one of the upper and the bottom surfaces of the base body. A cover coating is applied to the primer coating. The primer coating mixture is selected from the group consisting of a first composition comprised of water, amorphous silicon dioxide, aluminum dioxide, polyvinyl alcohol, and a copolymer of butadiene/styrene and acrylonitrile, and a second composition comprised of water, a silicon compound selected from the group consisting of silicic acid and silica gel, polyvinyl alcohol, and a copolymer of butadiene-styrene and acrylonitrile.

12 Claims, 1 Drawing Sheet

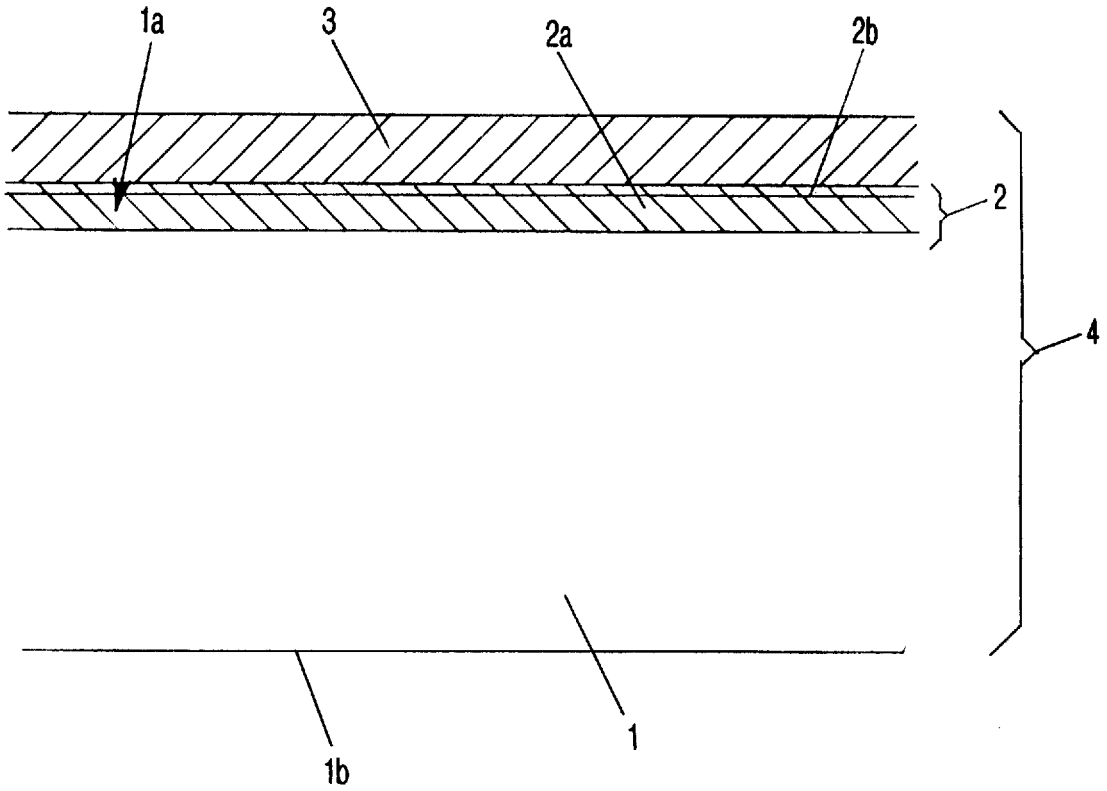
1a
3
2a
2b
2
4
1
1b

PAPER OR CARDBOARD PRODUCT

BACKGROUND OF THE INVENTION

The present invention relates to paper or cardboard with a coating comprised of a primary layer and a cover layer for providing an aroma/flavor and vapor seal.

Such coated papers or cardboards for providing an aroma and vapor seal have multiple uses. Depending on the respective certification of the employed components of the cover coating mixture and its layer thickness, the such embodied paper products, which in the context of the present invention include paper or cardboard, have, for example, use as: wrapping paper for reams of paper providing a moisture seal, hot-sealable wrapping paper for manufacturing protective packings for paper rolls, wrapping paper for providing a moisture seal, packing material for food stuffs, aroma/flavor-protecting packages, packaging material for liquid foods, packaging for flowable material, packaging for detergent powders, insulating paper for the construction industry, wall paper. Such paper products also provide a valuable raw material for recycling purposes. A sufficient vapor and aroma sealing action is required of such papers or cardboard materials, while at the same time all essential advantages of such paper or cardboard products should be maintained so that they are innocuous with respect to application in food packaging and provide oil and grease resistant surfaces. Furthermore, they must be tasteless and odorless, must be glueable with special glues or adhesives, must be sealable relative to itself as well as to other plastic coatings. Furthermore, these paper products should be easily recyclable and should be provided with only a minimal amount (weight) of coating material.

In the prior art it is known to coat paper or cardboard with a polyethylene (PE) coating in order to produce the aforementioned paper products. However, such paper products have considerable disadvantages in view of the well-known problems regarding recycling of PE-coated papers or cardboards.

Furthermore, as an alternative to PE coatings, polyvinylidene chloride coatings (PVDC) have been suggested for solving the problems relating to PE coatings whereby application amounts of at least 15 g/m$^2$ must be used (European document 0 375 924). These PVDC coatings however have the disadvantage of containing a chlorinated component. Furthermore, onto the barrier application of PVDC a further mineral-based application must be deposited in order to be able to print on such paper or cardboard materials. This however results in a rather cumbersome process.

Vapor and aroma/flavor seals have been accomplished by using coatings that contain a mixture of a plurality, preferably three, polymers, i.e., paraffin, carboxylated styrene butadiene, and polyacrylate (European document 0 393 451). The disadvantage of such coatings is that in the coating mixture a large amount of wax is contained in order to provide the required vapor and aroma/flavor lock. The application of extra material results in higher costs as well as in problems during recycling and hot-sealing processes.

In German Offenlegungsschrift 42 27 184 an impregnating component for manufacturing the aforementioned paper products having penetrating resistance against oil, grease, and aqueous media is suggested. The disclosed process comprises the step of machine-sizing the paper, especially with a sizing press of the paper-producing machine. However, the penetration resistance that is achievable with this method is only minimal and does not provide a vapor seal/barrier.

The disadvantage of paper or cardboard of the prior art is that for many packaging purposes the required vapor and flavor seal can only be achieved with very thick layers. This requires multiple steps of applying primer and cover coatings whereby the primer ensures the flavor seal and the cover ensures the vapor seal. However, the wax component contained in these coating mixtures is present in amounts which counteract a problem-free recycling.

It is therefore an object of the present invention to provide an improved paper or cardboard material with a coating that is comprised of a primer coating and a cover coating for providing a flavor and vapor seal.

SUMMARY OF THE INVENTION

A paper product according to the present invention is primarily characterized by:

A base body with an upper surface and a bottom surface;

A primer coating applied in the form of a primer coating mixture to at least one of the upper and the bottom surfaces of the base body;

A cover coating applied to the primer coating;

Wherein the primer coating mixture is selected from the group consisting of a first composition, comprised of water, amorphous silicon dioxide, aluminum oxide, polyvinyl alcohol, and a copolymer of acrylonitrile and butadiene-styrene, and a second composition, comprised of water, a silicon compound selected from the group consisting of silicic acid and silica gel, polyvinyl alcohol, and a copolymer of acrylonitrile and butadiene-styrene.

Preferably, the primer coating mixture further comprises starch.

Advantageously, the primer coating mixture is applied in amounts of 2.5 to 5 g/m$^2$.

Expediently, the cover coating is applied in the form of a cover coating mixture, wherein the cover coating mixture comprises at least one polymer dispersion.

In a preferred embodiment of the present invention the cover coating mixture comprises water, a butadiene-styrene copolymer modified with carnauba wax and paraffin wax, an ethylene/methacrylic acid dispersion, and polyvinyl acetate.

Expediently, the cover coating mixture is selected from the group consisting of a first mixture, comprised of water and a butadiene-styrene copolymer modified with carnauba wax and paraffin wax, a second mixture, comprised of water and an ethylene/methacrylic acid dispersion, a third mixture, comprised of water and carboxylated styrene-butadiene copolymer, and a fourth mixture, comprised of water and a styrene-acrylate copolymer dispersion.

Preferably, the cover coating comprises an additional layer applied with an additional coating mixture comprised of water and a styrene-acrylate copolymer dispersion.

In a preferred embodiment of the present invention the cover coating mixture further comprises polyvinyl acetate.

Advantageously, the cover coating mixture is applied in an amount of 5 to 10 g/m$^2$.

In a preferred embodiment of the present invention the primer coating and the cover coating are applied by means selected from the group consisting of a roller rake and an engraving system or modifications of such known devices.

Preferably, the upper and the bottom surfaces of the paper product have the primer coating and the cover coating applied thereto.

Preferably, the base body of the paper product is machine-sized.

According to the present invention it is suggested that the primer coating mixture is comprised of water, amorphous silicon dioxide, aluminum oxide, polyvinyl alcohol, and a copolymer of acrylonitrile and styrene/butadiene or, in the alternative, comprised of water, silicic acid or silica gel, polyvinyl alcohol, and a copolymer of acrylonitrile and styrene/butadiene.

With this measure a paper product, i.e., paper or cardboard, with an improved water vapor barrier and improved flavor seal is provided whereby any suitable raw paper material, for example, also recycling paper, or any suitable cardboard material can be used onto which, in a first step, the primer coating and subsequently the cover coating is applied. The gist of the present invention lies in a very special combined application, resulting in a synergistic effect, for producing the seal, wherein as the inventive step the combination of the special inventive primer coating with already known sealing coatings as a cover coating is employed. The disclosed primer coatings improve the previously only insufficiently exploited properties of these cover coatings considerably and provide comparable sealing or barrier effects when comparing the total weight of the applied coatings with the weight of conventional PE coatings. The inventive primer coating almost completely penetrates the surface area of the paper or cardboard. The special selection of individual components for the primer coating mixture ensures that after polymerization a saturation of the capillary fiber structures of the paper or cardboard is ensured. The components fill interstitial spaces that otherwise would promote adsorption and cover them with an amorphous net structure. With a respectively adjusted rheology of the cover coating mixture the remaining openings at the paper or cardboard surface, after completion of application of the primer coating mixture, provide for a sufficient anchoring of the cover coating mixture whereby a removal of the cover coating mixture upon impact is effectively suppressed. Thus, it is ensured that the aqueous components, necessary for an optimal polymerization, remain for a sufficiently long period of time within the cover coating mixture and improve the arrangement of the film-forming molecules. The gist of the present invention thus lies in that, for producing the required barrier, any cover coating mixture suitable for generating a vapor seal can be applied onto a special primer coating mixture in accordance with the present invention. For example, a barrier effect measured according to DIN 53122 Klima D by applying only the primer coating mixture is not detectable (more than 135 g/m$^2$/24 h). However, the primer coating resulting from the applied primer coating mixture substantially completely prevents migration of the polymer dispersion of the cover coating mixture into the paper or cardboard. This results in the formation of an improved network and thus in a denser film as well as in a reduction of the required amount of coating mixture to be applied which leads to thinner coatings. The inventive combined application of a certain primer coating mixture with a further cover coating mixture for generating a vapor seal results in all essential advantages of conventional PE-coated paper or cardboard and thus provides a fully satisfactory substitute for PE-coated paper products. These advantages are: the resulting papers and cardboards have sufficient vapor and flavor sealing action, are innocuous with respect to applications for food, are oil and grease resistant, are also tasteless and odorless, can be glued together with special adhesives, can be sealed relative to themselves and other plastic coatings. A major advantage is that the inventive papers or cardboards can be easily recycled and have a relatively low amount or weight of coating material applied thereto. Thus, the inventive papers or cardboards can be used as valuable raw material in a recycling process, in contrast to conventional PE-coated substrates, so that the recycling process is substantially facilitated and less expensive. Due to the high barrier effects obtainable with relatively small amounts of applied coating mixture, in comparison to conventional coating processes, especially in comparison to PE coatings, resources can be saved. Thus, the paper products that have been prepared according to the present invention can be used, as a function of the respective certification of the applied cover coating mixtures and their layer thickness, as ream wrapping paper with moisture barrier, hot-sealable packaging paper for manufacturing resistant packages for paper rolls, wrapping paper with moisture seal, packing material for foods, flavor-protecting packaging, packaging for liquid foods, packaging for flowable materials, packaging for detergent powders, insulating papers for the construction industry, wall paper etc.

In a further embodiment, the primer coating mixture further contains starch.

Advantageously, the amount of applied material of the primer coating mixture is between 2.5 to 5 g/m$^2$. The amount of applied material depends on the properties of the raw paper or cardboard.

In another embodiment it is suggested that the coating cover mixture contains one polymer dispersion or a mixture of a plurality of polymer dispersions. These polymer dispersion can be, for example, ethylene/methacrylate, polyvinyl acetate, styrene-butadiene, or copolymers derived from these polymers. With respect to the polymer dispersions it is important to realize that they, when used alone, provide only relatively low vapor sealing effects of approximately 15 to 20 g/m$^2$ per 24 hours (for application amounts of 20 g/m$^2$ dry weight). However, in connection with the special inventive primer coating mixture they provide substantially higher sealing or barrier effects, for example, 4 to 10 g/m$^2$/24 h for substantially reduced amounts of applied material (5 to 10 g/m$^2$). The amount of applied material of the primer coating mixture is within an area of 2.5 to 5 g/m$^2$, depending on the properties of the raw paper. A barrier effect according to DIN 53122 Klima D by applying only the primer coating mixture is not measurable (more than 135 g/m$^2$/24 h). However, the inventive primer coating mixture prevents almost entirely the migration of polymer dispersions into the paper or the cardboard. Thus, an improved network and a more dense film formation results as well as a reduction of the required amount of coating material (layer thickness).

A further development of the cover coating mixture suggests that it be comprised of the primary ingredients water, a styrene/butadiene copolymer modified with carnauba wax and paraffin wax, an ethylene/methacrylic acid dispersion as well as polyvinyl acetate. With these basic materials a suitable cover coating mixture can be produced for achieving a vapor barrier. It is also possible to use combinations of only some of the above components. It is only required that these combinations result in an effective vapor seal or barrier.

A further embodiment of the cover coating mixture suggests that it be comprised primarily of water and a copolymer of styrene and butadiene modified with carnauba wax and paraffin wax, or of water as well as an ethylene/methacrylic acid dispersion, or of water and carboxylated styrene/butadiene, or of water and a styrene/acrylate copolymer dispersion. With these combinations an optimal vapor barrier can be obtained so that in an optimal manner the already described synergistic effect can be achieved in conjunction with the special primer coating mixture.

The cover coating may comprise an additional layer or coating comprised of a coating mixture of water and a styrene/acrylate copolymer dispersion.

In another embodiment it is suggested that the cover coating mixture further comprises polyvinyl acetate.

The amount of applied material of the cover coating mixture should preferably be within a range of 5 to 10 g/m$^2$. The resulting thickness of the cover coating is sufficient for the disclosed cover coating mixtures in order to provide an optimal vapor barrier.

Furthermore, it is suggested that the application of the primer coating mixture and the cover coating mixture is carried out with a roller rake, an engraving system or modifications of these conventional apparatus. The application of the primer coating mixture and of the cover coating mixture can thus be performed with known application techniques that are suitable for generating a thin coating layer. Preferably, machines that comprise two application units are to be used.

Furthermore, it is suggested in another embodiment of the present invention that the paper or cardboard is to be coated on both the upper and bottom surfaces. The coatings may be, depending on the respective requirements and specifications, different on both surfaces whereby any combination of the inventively disclosed primer coating mixtures and cover coating mixtures is possible.

It is also suggested that the paper or cardboard be machine-sized. This results in a densification of the paper or cardboard surface and thus further enhances the effect of the primer coating.

BRIEF DESCRIPTION OF THE DRAWING

The object and advantages of the present invention will appear more clearly from the following specification in conjunction with the accompanying only drawing, in which in a schematic representation a section of the inventive paper product is shown with one primer coating and a subsequently applied cover coating for providing a flavor and vapor seal or barrier.

DESCRIPTION OF PREFERRED EMBODIMENTS

The present invention will now be described in detail with the aid of several specific embodiments utilizing the only FIGURE.

The FIGURE shows the paper or cardboard base body 1 in a purely schematic manner. The paper base body may be, for example, made of recycled paper.

On the paper or cardboard base body 1 with upper surface 1*a* and bottom surface 1*b* a primer coating 2 is applied. The chemical composition of the primer coating mixture for applying the primer coating 2 has been disclosed above. It is obvious from the drawing that the primer coating 2 almost completely penetrates the surface area of the paper or cardboard base body 1 as indicated at 2*a*. Only a small amount of primer 2*b* actually remains on the upper surface 1*a*. The special selection of individual components for the primer coating mixture for producing the primer coating 2 ensures, after polymerization, a saturation of the capillary fiber structure of the substrate (base body 1) and fills interstitial spaces that otherwise would be absorption-enhancing. Thus, the primer coating mixture coats these interstitial spaces with an amorphous net structure. With a respectively adjusted rheology of the cover coating mixture for applying a cover coating 3 onto the primer coating 2, the openings that remain after application of the primer coating 2 lead to a good anchoring of the cover coating 3 whereby a peeling-off or removal upon impact of the cover coating material is prevented. It is thus ensured that the required aqueous components for an optimal polymerization remain for a sufficient amount of time in the cover coating mixture and thus result in an improved arrangement of the film-forming molecules. The thus resulting paper product 4 improves the previously only insufficiently exploited characteristics of these cover coatings 3 considerably and achieves, with respect to the total weight in comparison to conventional PE coatings, comparable barrier effects. The great advantage is to be seen in the fact that the inventive paper products 4 can be easily recycled. The recycling process, in contrast to the one for PE-coated substrates, is substantially facilitated and thus less expensive. Furthermore, due to the relatively minimal weight of applied material, providing excellent barrier effects in comparison to conventional coating processes, resources (materials) can be saved. Moreover, it is also possible, without problems, to use recycled papers for the invention.

In the shown embodiment a one-sided coating is suggested. However, it is also possible to coat the upper surface as well as the bottom surface of the paper or cardboard base body with the inventive coatings.

The present invention is, of course, in no way restricted to the specific disclosure of the specification and drawings, but also encompasses any modifications within the scope of the appended claims.

What I claim is:

1. A paper product having a flavor seal and a vapor barrier, said paper product produced by the steps of:

providing a paper base body with an upper surface and a bottom surface;

selecting a primer coating mixture from the group consisting of a first composition comprised of water, amorphous silicon dioxide, aluminum oxide, polyvinyl alcohol, and a copolymer of acrylonitrile and butadiene-styrene, and a second composition comprised of water, a silicon compound selected from the group consisting of silicic acid and silica gel, polyvinyl alcohol, and a copolymer of acrylonitrile and butadiene-styrene;

applying the primer coating mixture to at least one of said upper and said bottom surfaces of said paper base body;

polymerizing the primer coating mixture to form an amorphous net structure on said paper base body;

applying a cover coating mixture suitable for generating a vapor seal.

2. A paper product according to claim 1, wherein said primer coating mixture further comprises starch.

3. A paper product according to claim 1, wherein said primer coating mixture is applied in amounts of 2.5 to 5 g/m$^2$.

4. A paper product according to claim 1, wherein said cover coating mixture comprises at least one polymer dispersion.

5. A paper product according to claim 4, wherein said cover coating mixture comprises water, a butadiene-styrene copolymer modified with carnauba wax and paraffin wax, an ethylene/methacrylic acid dispersion, and polyvinyl acetate.

6. A paper product according to claim 4, wherein said cover coating mixture is selected from the group consisting of a first mixture, comprised of water and a butadiene-styrene copolymer modified with carnauba wax and paraffin wax, a second mixture, comprised of water and an ethylene/methacrylic acid dispersion, a third mixture, comprised of water and carboxylated styrene-butadiene copolymer, and a fourth mixture, comprised of water and a styrene-acrylate copolymer dispersion.

7. A paper product according to claim 6, wherein an additional coating mixture comprised of water and a styrene-acrylate copolymer dispersion is applied after applying the cover coating mixture.

8. A paper product according to claim 6, wherein said cover coating mixture further comprises polyvinyl acetate.

9. A paper product according to claim 1, wherein said cover coating mixture is applied in an amount of 5–10 $g/m^2$.

10. A paper product according to claim 1, wherein said primer coating and said cover coating are applied by means selected from the group consisting of a roller rake and an engraving system.

11. A paper product according to claim 1, wherein said upper and said bottom surfaces of said paper product have said primer coating and said cover coating applied thereto.

12. A paper product according to claim 1, wherein said base body is machine-sized.

* * * * *